US006386693B1

(12) United States Patent
Michele et al.

(10) Patent No.: US 6,386,693 B1
(45) Date of Patent: May 14, 2002

(54) INK SUPPLY TANK FOR AN INKJET PRINT HEAD

(75) Inventors: Helmut Michele, Castrop-Rauxel; Dirk Klein, Hagen; Peter Busch, Bochum, all of (DE)

(73) Assignee: Artech GmbH design and production in plastic (DE)

( * ) Notice: Subject to any disclaimer, the term of this patent is extended or adjusted under 35 U.S.C. 154(b) by 0 days.

(21) Appl. No.: 09/653,765

(22) Filed: Sep. 1, 2000

(51) Int. Cl.[7] ..... B41J 2/175
(52) U.S. Cl. ..... 347/86; 347/85
(58) Field of Search ..... 347/84, 85, 86, 347/87

(56) References Cited

U.S. PATENT DOCUMENTS

| | | | | |
|---|---|---|---|---|
| 4,162,501 | A | 7/1979 | Mitchell et al. | 347/86 |
| 5,187,498 | A | 2/1993 | Burger | 347/86 |
| 5,777,646 | A | 7/1998 | Barinaga et al. | 347/86 |
| 5,784,087 | A | 7/1998 | Wallace et al. | 347/86 |
| 5,825,387 | A | 10/1998 | Cowger et al. | 347/86 |
| 5,844,579 | A | 12/1998 | Barinaga et al. | 347/7 |
| 6,010,211 | A | 1/2000 | Betschon | 347/86 |

FOREIGN PATENT DOCUMENTS

| | | | | |
|---|---|---|---|---|
| DE | 2300523 | | 7/1974 | |
| DE | 2639697 | | 8/1978 | |
| DE | 2524757 | | 8/1979 | |
| DE | 2657587 | | 1/1980 | |
| DE | 3024678 | | 1/1982 | |
| DE | 3644 095 | A1 | 7/1988 | B41J/27/00 |
| EP | 0 560 729 | A2 | 3/1993 | B41J/2/175 |
| EP | 870618 | | 4/1998 | |
| EP | 00 11 9054 | | 2/2001 | |
| JP | 63153146 | * | 6/1988 | B41J/3/04 |
| WO | 98/55323 | | 12/1998 | |

* cited by examiner

*Primary Examiner*—Anh T. N. Vo
(74) *Attorney, Agent, or Firm*—Hoffman Wasson & Gitler PC

(57) ABSTRACT

The present invention pertains to an ink supply tank for an inkjet print head that can be installed in fixed fashion in an inkjet printer, having an ink reservoir that can be connected to an ink supply line leading to an inkjet print head, and having an ink delivery device that has actuating elements accessible from the outside, which can be brought into active engagement with corresponding, motor-powered drive elements of the inkjet printer, in which the ink delivery device feeds ink into the ink supply line at overpressure upon actuation of the actuating elements. In order to reduce the manufacturing effort and ensure a high level of functional reliability with an ink supply tank of such a type, the invention suggests that the ink delivery device have a pressure-generating device that acts on the ink reservoir and is coupled with the actuating elements, and that provides the ink reservoir with overpressure when the actuating elements are driven.

26 Claims, 1 Drawing Sheet

INK SUPPLY TANK FOR AN INKJET PRINT HEAD

FIELD OF THE INVENTION

Figure 1:
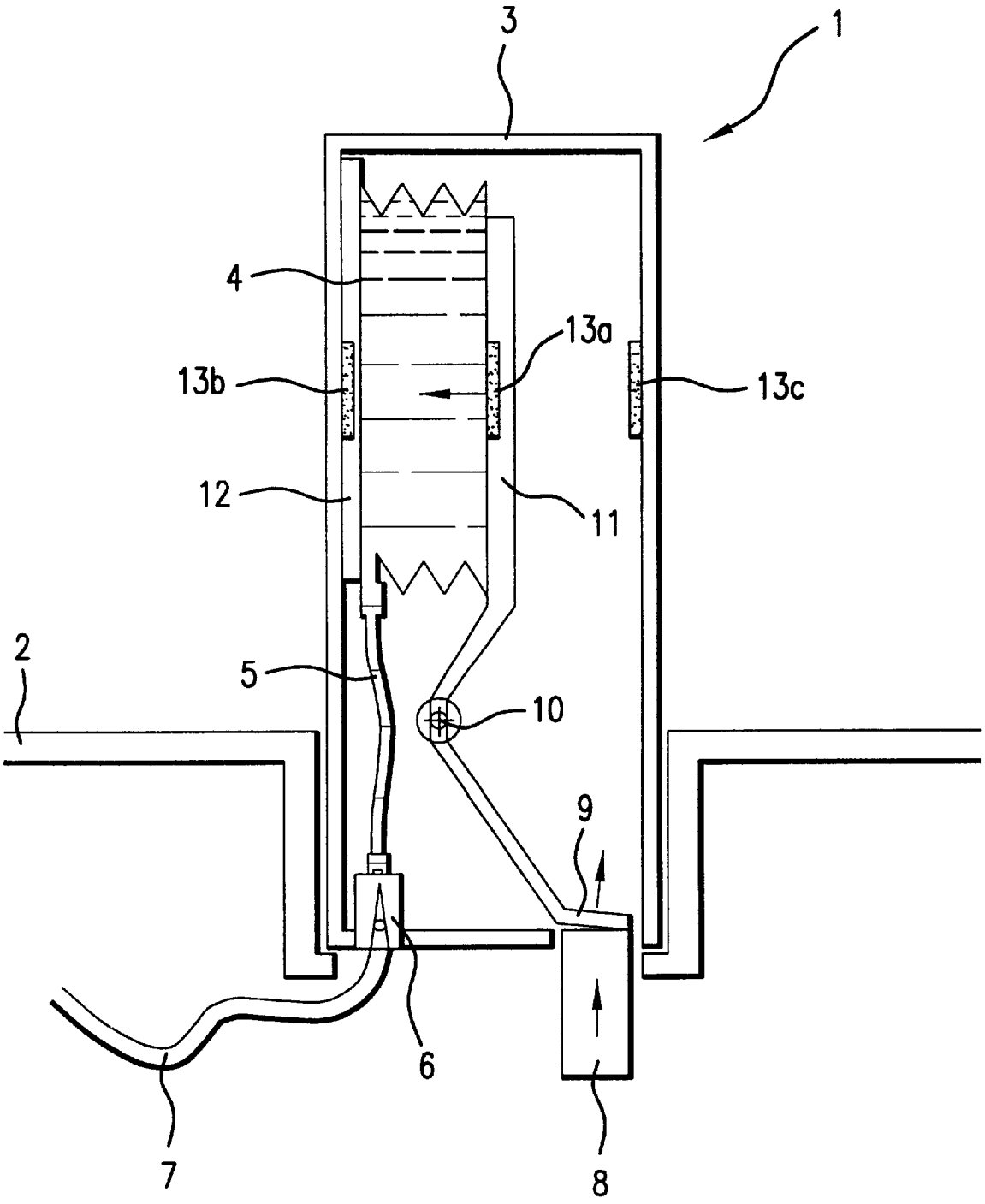

The present invention pertains to an ink supply tank for an inkjet print head that can be installed in fixed fashion in an inkjet printer, having an ink reservoir that can be connected to an ink supply line leading to an inkjet print head, and having an ink delivery device that has actuating elements accessible from the outside, which can be brought into active engagement with corresponding, motor-powered drive elements of the inkjet printer, whereby the ink delivery device feeds ink into the ink supply line at overpressure upon actuation of the actuating elements.

1. PRIOR ART

A central component of the inkjet printer is the inkjet print head, which can be positioned relative to the printable area by means of suitable mechanicals and which creates the printed image through the controlled discharge of ink from a multiplicity of fine print nozzles. The continuous supplying of the print head with ink takes place from an ink reservoir that holds a rather large quantity of ink. For simple black/white inkjet printers, the inkjet print head is configured as a one-piece, replaceable unit along with the ink reservoir. As a result of the trend towards higher and higher printing speeds and the rapid acceleration of the print head required for doing that, a design has become popular, because of the reduction of the moving masses, in which the ink container is now to be accommodated in a separate, replaceable ink supply tank, which is installed in the printer in fixed fashion and is connected by means of a flexible ink supply line with the moving inkjet print head. An additional reason for this development is the increasing use of four-color printers, which accordingly require four ink reservoirs.

An ink tank having the features mentioned at the beginning and configured separately from the print head is described in U.S. Pat. No. 5,777,646, for example. It has, along with an ink reservoir, an active ink delivery device connected to that, which is used to provide the ink supply lines with pressure. That has to be done in order to ensure a continuous flow of ink during all of the acceleration states that occur in practice. Specifically, this ink delivery device is configured in the form of a small pump that has as its actuating element a flexible pump bellows, which is accessible from outside and which is actuated, i.e., pressed together, by motor powered actuating cams on the printer whenever a print job is pending. This active actuation of the pump device has the advantage that adequate ink operating pressure, of the order of magnitude of about 0.2 to 0.3 bar, is built up for each print job over the entire lifetime of the ink supply tank, independently of how full the ink reservoir is.

One significant disadvantage of the known ink supply tank with active ink delivery, however, is the fact that the pump mechanism for ink delivery is made up of a number of individual components. For example, a separate pump chamber is required, which is connected to the ink reservoir by means of a check valve. In addition, pistons or bellows-like diaphragms that are matched to the drive elements, e.g., the actuating cams on the printer, have to be attached to the pump chamber. The mechanical effort that has been required up to now emerges in impressive fashion from U.S. Pat. No. 5,784,087 U.S. Pat. No. 5,825,387 U.S. Pat. No. 5,844,579, and EP 0 870 618 A2, for example.

In view of the previously known state of the art, the task on which the invention is based consists of making available an ink supply tank that has an active ink delivery in accordance with the functional principle explained at the beginning, and has a simpler design and requires less mechanical effort for its manufacture, with correspondingly lower costs.

2. SUMMARY OF THE INVENTION

To carry out this task, the invention suggests that, starting from an ink supply tank with the features mentioned at the beginning, the ink delivery device has a pressure-generating device that acts on the ink reservoir and is coupled with the actuating elements, and provides the ink reservoir with overpressure upon actuation of the actuating elements.

The characteristic feature of the configuration according to the invention lies in the fact that a new kind of functional principle for the automatic delivery of ink is implemented, which differs fundamentally from all of the actively printer-actuated ink supply tanks known previously according to the state of the art. To be specific, in the state of the art up to now, as a matter of principle the ink was first drawn from the ink reservoir by the ink delivery device, compressed in a type of pump chamber and then sent from there into the ink supply line. The present invention is now based on the knowledge that the reason for all of the mechanical complexity that made for manufacturing problems lay in the fact that the ink pump device is incorporated between the ink reservoir and the ink supply line. By contrast, the invention now provides that an overpressure is built up in the ink reservoir directly by the actuating elements, which continue to be actively drivable by the printer. As a result, the supply line according to the invention, which is connected directly to the ink reservoir, is also provided with overpressure. The pressure-generating device provided by the invention for this purpose can be designed extremely very simply in terms of its mechanics. Specifically, in the simplest case it is enough to compress the ink reservoir mechanically by means of the actuating elements, so that the ink content is pressed into the supply line with overpressure.

A preferred embodiment of the invention therefore provides that the ink reservoir is designed so that it can be compressed mechanically, and that the pressure-generating device has a pressure plunger that is coupled with the actuating elements and compresses the ink reservoir when they are actuated. The ink reservoir is completely or partly made of a flexible, deformable material. When a force is exerted on the actuating elements by the printer's drive elements, the pressure plunger presses against the deformable ink reservoir, so that a corresponding overpressure is built up inside its volume, i.e., within the essentially incompressible ink, which is then transmitted to the ink supply line.

The compressible ink reservoir can be configured in a bellows-like manner, with formed creases or folds, for example, so that it can be compressed in one direction. As an alternative, it can be configured as a foil bag with at least one flexible sidewall. It is also conceivable in this regard to make the reservoir entirely in the form of a foil bag or bubble, or to attach a more or less rigid peripheral frame, the frame openings of which are tightly sealed off with deformable foil that is applied to it.

It is also advantageous if the actuating elements have a force-increasing transmission acting on the pressure plunger. A force-multiplying transmission of this type can be designed as a lever transmission, for example. This contains, for example, simple and double levers and is used to convert the actuating force exerted by the drive element, i.e., the printer's actuating cams, into a larger pressing force by the pressure plunger. It is thus possible to match the given stroke and actuating force to the pressing force of the pressure plunger in the best possible way so that the required ink overpressure is always built up.

It is also advantageous that the actuating elements have spring elements that compress the ink reservoir in a spring-preloaded fashion. For example, these spring elements are configured in such a way that when the ink supply tank according to the invention is inserted into the corresponding seat in the printer, they are pressed against an abutment placed there. As a result, they exert a predetermined compressive strain on the ink reservoir, which by itself leads to the generation of a minimum ink overpressure in the ink supply lines. All that is then necessary in order to generate the operating overpressure is the exerting of an additional force by the printer's actively triggered drive elements. This is especially helpful for complete utilization of the volume of ink, and ink pressure that is adequate at all times.

As an alternative, the actuating elements can have latching and blocking elements that latch the pressure plunger in the pressed state and block the direction that is opposite to the pressing direction. The functional principle this is based on is known, for example, from mechanical cranes or presses: During an actuating stroke, the pressure plunger is pushed in the pressing direction past a latching position, and is held there by the latching and blocking catches. With a subsequent actuating stroke, the pressure plunger is either pressed one latch further in the pressing direction—or—it remains in the latched position if, as a result of the overpressure prevailing inside it, the mechanical resistance of the ink reservoir is great enough that no additional increase in pressure can be brought about at that time by movement of the drive element.

With regard to the pressure plunger, it is preferable that placed behind the foil bag is a fixed abutment that is formed to correspond to the pressure plunger. What is meant by this is that the pressure plunger is, for example, convex in shape, while the abutment is correspondingly formed concavely, so that when the pressure plunger presses against the abutment, the ink contained in the foil bag located between them is forced out with nothing left behind, i.e., it is pressed into the ink supply lines. In this way, a practically complete utilization of the ink contained in the ink bag is obtained.

A practical and particularly simple version of the invention provides that the pressure plunger and the actuating element are configured in one piece as a spring-loaded double lever that is made of an elastic material and is supported in pivoting fashion in a housing of the ink supply tank. The double lever can, for example, be realized in the form of a spring steel strap that simultaneously provides for a force multiplication of the actuating force exerted by the drive element, and for the spring preloading of the pressure plunger. The strap is advantageously given a bent shape, and matches a corresponding abutment. A latching and blocking device can also be present.

An advantageous further development of the invention provides that the pressure-generating device is equipped with a pressure pump, which is coupled to the actuating elements and which, when activated, provides the interior of the ink reservoir with overpressure. For example, it can be a simple, small diaphragm air pump that either provides the ink reservoir with air pressure directly—or—fills a positive displacement body or balloon with overpressure.

Of course, in the case of the latter version, a force-increasing transmission in the form of levers or something similar, a device for spring preloading, and latching and blocking elements can also be present.

An alternative design provides that the ink supply tank is connected by means of a control valve to a pressure storage unit that is coupled with the actuating elements and is opened when they are actuated. As a result, in practice a servo-controlled pressure-generating device is created. A high-pressure gas cartridge that contains carbon dioxide, liquid gas or something similar, for example, can be present as the pressure storage unit. Upon a moving of the actuating elements by the printer's drive elements, the control valve is opened, which either directs the highly pressurized medium of this pressure storage unit directly into the ink reservoir or provides pressure to a positive-displacement device or other pressure-transmitting device, such as a pressure plunger or something similar.

The ink reservoir and the ink discharge device are advantageously placed in a housing that can be detachably placed into a corresponding seating device of the inkjet printer. The actuating elements are preferably to be fitted in a recess or opening of the housing into which a linearly displaceable drive element of the inkjet printer can be introduced, for example, an actuating cam or drive plunger.

In order to be able to obtain information about how much ink is still contained in the ink reservoir in the case of a supply tank with the features mentioned at the beginning, a particularly advantageous possibility lies in the fact that the ink reservoir can be compressed, and that at least one measuring element can be placed on it that moves relative to a second measuring element with the compressing of the ink reservoir. In principle, this step, which is especially simple technically, can be used whenever the ink reservoir is configured, for example, as a foil bag or bellows that of necessity deforms, i.e., contracts, as the ink flows out. According to the present invention, a measuring element is simply coupled with the movable reservoir walls. A second measuring element is installed in the housing in fixed fashion, for example, so that the distance between the two measuring elements changes with an emptying of the ink reservoir and the contracting or compressing that is associated with it, and the distance can be detected as a measured value and provides a point of reference for how full the ink reservoir is.

In principle, there are various equivalent alternatives for arranging the measuring elements. For example, one measuring element can be mounted directly on the ink reservoir, e.g., on a wall of a foil bag, or even on a pressing plunger that can be pressed against the ink reservoir and whose travel is also correlated with the amount of ink. A measuring element is advantageously mounted in fixed fashion on the housing of the ink supply tank so that the distance to the second sensor—depending on the arrangement—either increases or decreases as the ink reservoir empties.

In the simplest case, the measuring elements can have switching contacts that, for example, close a circuit when the ink reservoir collapses or is compressed as it empties. The use of inductive or capacitive or optical sensors or something similar has the advantage that a continuous detection of the amount of ink can be carried out with little effort. All of the embodiments have the advantage in this regard that a reliable indication of the amount can be realized with little effort. This applies in particular to embodiments in which the ink reservoir is compressed by an actively actuated pressing plunger, but is not limited to such an embodiment, i.e., it can also be implemented with conventional ink supply tanks with non-loaded or springpreloaded ink reservoirs.

DETAILED DECRIOTION OF THE DRAWINGS

In the following, embodiments of the invention are explained in more detail with the aid of the drawings. Specifically, the following is shown:

FIG. 1 A cross section through an ink supply tank according to the invention, shown as a schematic representation.

DETAILED DESCRIPTION OF A PREFERRED EMBODIMENT

In the schematic cross-section representation according to FIG. 1, an ink supply tank according to the invention is designated by reference number 1. It is placed in the corresponding holding well of an inkjet printer 2, which is only indicated.

The ink supply tank 1 has a housing 3 in which is placed an ink reservoir 4 completely filled with ink. This ink reservoir 4 is configured as a bellows-like foil bag, which can be compressed in the direction of the white arrow. Its interior is connected by means of a connecting tube with a connecting means that is accessible from outside, e.g., a septum or a connecting valve. An ink supply line 7 that leads to the inkjet print head of the printer 2 can be connected to this connecting means 6 as shown.

Designated by reference number 8 is a drive element of the printer 2, which element is shown in its idle position and which can be displaced in the direction of the arrow by a motor-powered driving means. Through an opening in the housing 3, this drive element 8 can be moved against an actuating element in the form of an actuating lever 9, which is supported in the housing 3 in pivoting fashion by a bearing 10. When actuated by the drive element 8, this actuating lever 9 is pivoted in a counterclockwise direction around the bearing 10, as is shown by the white arrow at the bottom.

Joined with the actuating lever 9 as one piece in the form of a double lever is a pressure plunger 11. It is pivoted in the direction of the white arrow when the actuating lever 9 is actuated in the direction of the arrow by the drive element 8.

On the side opposite the pressure plunger 11, the ink reservoir 4 lies against an abutment 12 on the wall of the housing.

The illustrated ink supply tank 1 functions as follows: When the printer 2 receives a print job, the drive element 8 is moved in the direction of the arrow by a motor-powered driving means (not shown) and thus acts upon the actuating lever 9. Via the bearing 10, the movement of the actuating lever 9 leads to a pivoting of the pressure plunger 11. The latter then compresses the compressible ink reservoir 4 against the abutment 12. The ink in its interior is thus pressurized. The ink overpressure propagates through the connecting tube 5 and the connecting means 6 into the ink supply line 7. In this way, adequate operating pressure for the print head is built up in the ink supply line with each incoming print job.

The force multiplication of the actuating lever 9 and the configuration of the ink reservoir 4 and the housing 3 are adapted to the individual requirements. For example, it is thus possible to form the pressure plunger 11 and the actuating lever 9 from one piece of elastic material, spring steel sheet, for example, which in the installed state is exerting spring pressure on the ink reservoir 4 even without actuation by the drive element 8, and is thus generating a certain minimum ink pressure.

Schematically designated by reference numbers 13*a*, 13*b* and 13*c* are electrical or electronic measuring elements, which, for example, include capacitive, inductive or optical sensors such as measuring coils, Hall sensors, capacitor plates, optical sending and receiving components, or something similar. Measuring element 13*a* is mounted on the movable wall of the ink reservoir 4 or on the pressure plunger 11 that is resting against it. A measuring element 13*b* or, as an alternative to that, 13*c*, is installed in the housing 3 in fixed fashion.

As the content of the ink reservoir 4 decreases, the wall lying towards the right in the drawing moves together with the pressure plunger 11 in the direction of the arrow, so that the distance decreases between measuring elements 13*a* and 13*b*, or increases between 13*a* and 13*c*. This change in distance is a direct measure of how full the ink reservoir 4 is, and it can be detected with little effort by means of a suitable electronic distance-measuring device (not shown) between a given pair of sensors 13.

It can already be seen by looking at the illustrations that the ink supply tank 1 according to the invention can be constructed in an especially simple way, and accordingly requires little manufacturing effort. At the same time, this design ensures especially high operational reliability.

What is claimed is:

1. An ink supply tank for an inkjet print head that can be installed in fixed fashion in an inkjet printer comprising:

a housing, an ink reservoir in said housing, said ink reservoir having a connection to an ink supply line leading to an inkjet print head;

an ink delivery device having actuating elements accessible from outside of the housing which can be brought into active engagement with drive elements of said inkjet printer, whereby said ink delivery device feeds ink into said ink supply line at overpressure upon actuation of said actuating elements; and said ink delivery device has a pressure-generating device acting on said ink reservoir and coupled with said actuating element to provide said ink reservoir with overpressure upon actuation of said actuating elements.

2. The ink supply tank according to claim 1, wherein said ink reservoir is designed so that it can be compressed mechanically, and that said pressure-generating device has a pressure plunger that is coupled with said actuating elements and compresses said ink reservoir when they are actuated.

3. The ink supply tank according to claim 2, wherein said ink reservoir is configured with a bellows structure.

4. The ink supply tank according to claim 2, wherein said ink reservoir is configured at least in part as a foil bag and has at least one flexible side wall.

5. The ink supply tank according to claim 2, wherein said actuating elements further include a force-increasing transmission acting on said pressure plunger.

6. The ink supply tank according to claim 5, wherein said pressure plunger and said abutment are curved.

7. The ink supply tank according to claim 2, wherein said actuating elements further comprise spring elements that compress said ink reservoir in a spring-preloaded fashion.

8. The ink supply tank according to claim 2, wherein said actuating elements further comprise latching and blocking elements that latch said pressure plunger in a pressed state and block the direction opposite a pressing direction.

9. The ink supply tank according to claim 4, wherein with regard to said pressure plunger, placed behind said foil bag is a fixed abutment that is formed to correspond to said pressure plunger.

10. The ink supply tank according to claim 9, wherein said force-increasing transmission is designed as a lever transmission.

11. The ink supply tank according to claim 1, wherein said pressure plunger and said actuating element are configured in one piece as an elastic double lever that is made of an elastic material and is supported in pivoting fashion in a housing of said ink supply tank.

12. The ink supply tank according to claim 11, wherein said double lever is configured as a spring steel strap.

13. The ink supply tank according to claim 1, wherein said pressure-generating device has a pressure pump, which is coupled to said actuating elements and which, when activated, provides the interior of said ink reservoir with overpressure.

14. The ink supply tank according to claim 1, wherein said ink reservoir is connected by means of a control valve to a pressure storage unit that is coupled with said actuating elements and is opened when they are actuated.

15. The ink supply tank according to claim 14, wherein said housing has a recess in which said actuating elements are placed into a linearly displaceable drive element of said inkjet printer.

16. The ink supply tank according to claim 1, wherein said ink reservoir and said ink discharge device are placed in a housing that can be detachably placed into a corresponding seating device of the inkjet printer.

17. The ink supply tank, in particular, according to claim 1, wherein said ink reservoir can be compressed and that a first measuring element is placed thereon, which moves relative to a second measuring element when said ink reservoir is compressed, whereby the distance between said measuring elements can be detected as a measured value.

18. The ink supply tank according to claim 17, wherein said first measuring element is mounted on said ink reservoir.

19. The ink supply tank according to claim 17, wherein said first measuring element is mounted on said pressure plunger.

20. The ink supply tank according to claim 17, wherein said second measuring element is mounted on said housing.

21. The ink supply tank according to claim 17, wherein said measuring elements have switching contacts.

22. The ink supply tank according to claim 17, wherein said measuring elements have inductive or capacitive or optical sensors.

23. An ink supply tank for a printer, comprising:

a housing, said housing having an aperture, an ink reservoir for holding ink, a pressure generating device acting on said ink reservoir for applying pressure, and an actuating device extending between said pressure generating device and said aperture.

24. The ink supply tank of claim 23, wherein said pressure generating device and actuating device are formed as a single piece.

25. The ink supply tank of claim 23, further comprising an abutment, said ink reservoir positioned between said abutment and said pressure generating device.

26. The ink supply tank of claim 23, further comprising a connector for connecting said ink reservoir to a print head.

* * * * *